US005919055A

United States Patent [19]

Hattori

[11] Patent Number: 5,919,055

[45] Date of Patent: Jul. 6, 1999

[54] CONSTRUCTION OF CONNECTING ELECTRIC CONNECTION BOX FOR INSTRUMENT PANEL HARNESS

[75] Inventor: Yasuhiro Hattori, Nagoya, Japan

[73] Assignees: Harness System Technologies Research, Ltd., Nagoya; Sumitomo Wiring Systems, Ltd., Yokkaichi; Sumitomo Electric Industries, Ltd., Osaka, all of Japan

[21] Appl. No.: 08/760,351

[22] Filed: Dec. 4, 1996

[30] Foreign Application Priority Data

Dec. 28, 1995 [JP] Japan ..... 7-342655

[51] Int. Cl.[6] ..... H01R 13/62

[52] U.S. Cl. ..... 439/310; 439/372

[58] Field of Search ..... 439/310, 372, 439/34, 157

[56] References Cited

U.S. PATENT DOCUMENTS

| | | | |
|---|---|---|---|
| 3,345,604 | 10/1967 | Henschen et al. | 439/310 |
| 4,815,984 | 3/1989 | Sugiyama et al. | 439/211 |
| 4,929,182 | 5/1990 | Hyogo et al. | 439/34 |
| 5,263,871 | 11/1993 | Sano | 439/372 |
| 5,308,255 | 5/1994 | Yamanashi | 439/157 |
| 5,425,169 | 6/1995 | Steinman et al. | 29/758 |
| 5,487,680 | 1/1996 | Yamanashi | 439/34 |
| 5,641,296 | 6/1997 | Larabell et al. | 439/157 |
| 5,642,999 | 7/1997 | Kidd et al. | 439/34 |

FOREIGN PATENT DOCUMENTS

| | | |
|---|---|---|
| 43 27 648 A1 | 3/1994 | Germany . |
| 6 215828 | 8/1994 | Japan . |
| 2 118 786 | 11/1983 | United Kingdom . |

*Primary Examiner*—Paula Bradley
*Assistant Examiner*—Tho D. Ta
*Attorney, Agent, or Firm*—Oliff & Berridge,PLC

[57] ABSTRACT

A connector portion is formed on an upper surface of an electric connection box to be mounted on a cowl panel mounted on a body, and a connector, connected to an instrument panel harness mounted on an instrument panel, is fittingly connected directly to the connector portion. Connectors of other wire harnesses are fittingly connected to connector portions formed on surfaces of the electric connection box other than the upper surface thereof. The connector is mounted on the instrument panel through resilient support members. The electric connection box is mounted on the cowl panel so as to move upward and downward relative to the cowl panel.

13 Claims, 7 Drawing Sheets

CONSTRUCTION OF CONNECTING ELECTRIC CONNECTION BOX FOR INSTRUMENT PANEL HARNESS

BACKGROUND OF THE INVENTION

1. Field of the Invention

This invention relates to a construction of connecting an electric connection box for an instrument panel harness, and more particularly to the type of construction in which a connector can be fittingly connected to an upper surface of the electric connection box, and enhancing the efficiency of the connector fitting operation.

2. Description of Related Art

As shown in FIG. 10A and 10B, in a conventional construction, an instrument panel 3 is fixedly secured to an upper portion of a cowl panel 2 in a compartment of an automobile 1, and a connector 5 of an instrument panel harness 4, mounted on the instrument panel 3, is fitted in and connected to a connector portion of an electric connection box 6 fixed to a lower portion of the cowl panel 2.

However, the above electric connection box 6 is fixedly secured to a deep portion of the cowl panel 2, and therefore it has been difficult to fittingly connect the connector 5 of the instrument panel harness 4 to the connector portion of the electric connection box 6 after the large size instrument panel 3 is fixed to the cowl panel.

The present invention has been made to overcome the above problem, and an object of the invention is to provide a construction of connecting an electric connection box for an instrument panel harness in which a connector can be fittingly connected to an upper surface of the electric connection box, and to improve the efficiency of the connector fitting operation.

SUMMARY OF THE INVENTION

To achieve the above object, there is provided a construction of connecting an electric connection box for an instrument panel harness wherein a connector portion is formed on an upper surface of the electric connection box to be mounted on a cowl panel mounted on a body; a connector, connected to the instrument panel harness mounted on an instrument panel, is fittingly connected to the connector portion; connectors of other wire harnesses are fittingly connected to connector portions formed on surfaces of the electric connection box other than the upper surface thereof.

The connector of the instrument panel harness mounted on the instrument panel is fittingly connected to the connector portion formed on the upper surface of the electric connection box mounted on the cowl panel, and the connectors of other wire harnesses are fittingly connected to connector portions formed on surfaces of the electric connection box other than the upper surface thereof. Therefore the connector portion, which must be provided on a surface other than the upper surface of the electric connection box in the conventional construction, can be formed on the upper surface, and thereafter the electric connection box can be formed into a smaller size.

Preferably, the connector of the instrument panel harness is mounted on the instrument panel through resilient support members.

With this construction, vibrations of the instrument panel will not be transmitted to the connector fitting portion because of the provision of the resilient support members, and therefore the reliability of the connector fitting portion is enhanced.

Preferably, the electric connection box is mounted on the cowl panel so as to move upward and downward relative to the cowl panel.

With this construction, by moving the electric connection box upward and downward relative to the cowl panel, the connector portion of the electric connection box can be automatically fitted in the connector on the instrument panel.

In one preferred form of the invention, an operating lever is pivotally movably mounted on the cowl panel, and the electric connection box is slidably supported on upper surfaces of cam portions formed on the operating lever, and by pivotally moving the operating lever, the electric connection box is moved upward and downward.

With this construction, by pivotally moving the operating lever mounted on the cowl panel, the electric connection box is moved upward through the cam portions, so that the connector portion of the electric connection box is automatically fitted in the connector on the instrument panel, thereby enhancing the efficiency of the fitting operation.

In another preferred form of the invention, the electric connection box is fixed to the cowl panel, and an operating lever is pivotally movably mounted on the electric connection box, and fitting portions are formed in the operating lever, and pins for fitting respectively in the fitting portions are formed on the connector of the instrument panel harness, and by operating the operating lever, the connector is moved upward and downward so as to fittingly connect the connector to the connector portion of the electric connection box.

With this construction, by pivotally moving the operating lever mounted on the electric connection box, the connector on the instrument panel is moved downward through the fitting portions and the pins, and is automatically fitted on the connector portion of the electric connection box, thereby enhancing the efficiency of the fitting operation.

As is clear from the foregoing description, the connector of the instrument panel harness mounted on the instrument panel is fittingly connected directly to the connector portion formed on the upper surface of the electric connection box mounted on the cowl panel. Therefore the connector portion, which must be provided on a surface other than the upper surface of the electric connection box in the conventional construction, can be formed on the upper surface, and therefore the electric connection box can be formed into a smaller size.

Preferably, the connector is mounted on the instrument panel through resilient support members, and with this construction vibrations of the instrument panel will not be transmitted to the connector fitting portion, and therefore the reliability of the connector fitting portion is enhanced.

By moving the electric connection box upward and downward relative to the cowl panel, the connector portion of the electric connection box can be automatically fitted in the connector on the instrument panel.

By pivotally moving an operating lever mounted on the cowl panel, the electric connection box is moved upward, so that the connector portion of the electric connection box is automatically fitted in the connector on the instrument panel. Alternatively, by pivotally moving an operating lever mounted on the electric connection box, the connector on the instrument panel is moved downward, and is automatically fitted on the connector portion of the electric connection box. With such construction, the efficiency of the fitting operation is enhanced.

DETAILED DESCRIPTION OF PREFERRED EMBODIMENTS

Preferred embodiments of the present invention will now be described in detail with reference to the drawings.

Figure 1:
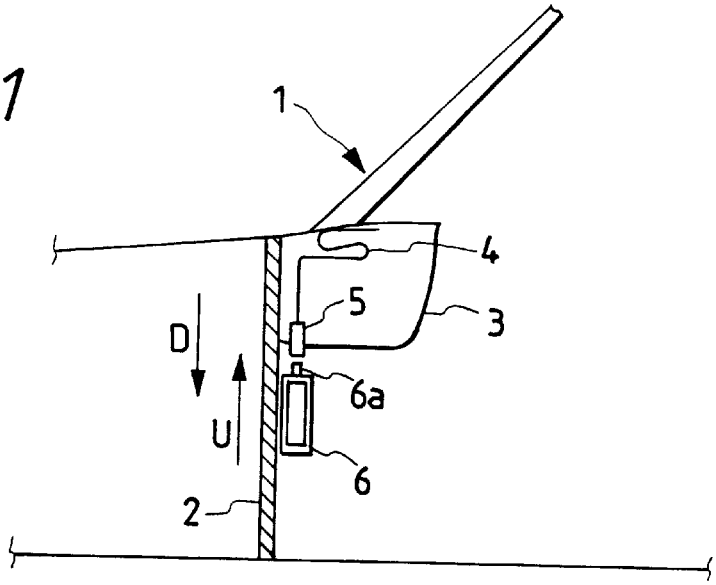
FIG. 1 is a side-elevational view showing a basic form of a connection construction of the present invention.

FIG. 1 is a basic view showing a connection construction of the present invention. A connector portion 6*a* is formed on an upper surface of an electric connection box 6 to be attached to a cowl panel 2 of an automobile 1, and a connector 5, connected to an instrument panel harness 4 mounted on an instrument panel 3, is fittingly connected directly to the connector portion 6*a* formed on the upper surface of the electric connection box 6. For effecting this fitting connection, in one embodiment, the electric connection box 6 is moved upward as indicated by arrow U, and in another embodiment the connector 5 is moved downward as indicated by arrow D.

FIGS. 1 to 7 show the first embodiment in which the electric connection box 6 is moved upward to effect the fitting connection.

Figure 3A:
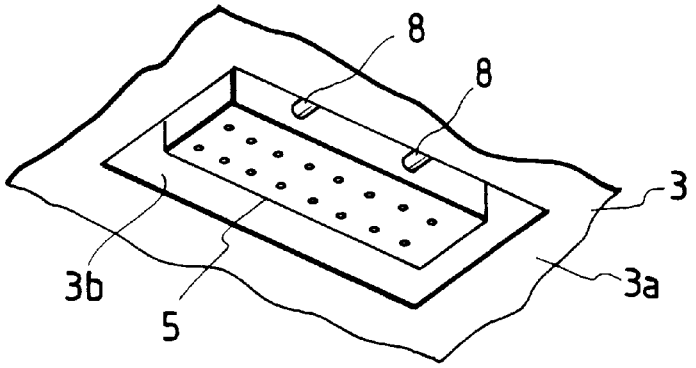
FIG. 3(A) is a view showing the lower side of an instrument panel having a connector mounted thereon.
Figure 3B:
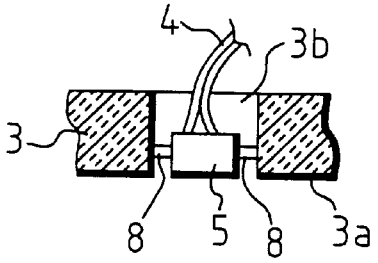
FIG. 3(B) is a cross-sectional view of this connector as seen from a side thereof.
Figure 3C:
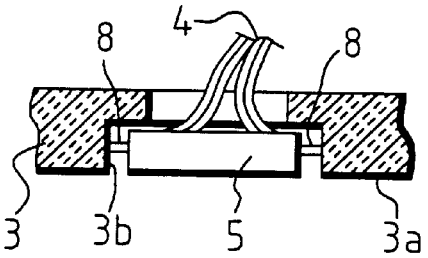
FIG. 3(C) is a cross-sectional view of this connector as seen from a front side thereof.

FIG. 3(A) is a view showing the lower side of the instrument panel 3, and as shown in FIGS. 3(A) to 3(C), an elongate groove 3*b* is formed in the lower surface of the instrument panel 3, and extends in a direction of the width of the vehicle, and the connector 5 of the instrument panel harness 4 is loosely fitted in the elongate groove 3*b*. The connector 5 is resiliently mounted in the elongate groove 3*b* through resilient support members 8 each comprising a rubber member, a spring or the like.

Figure 2:
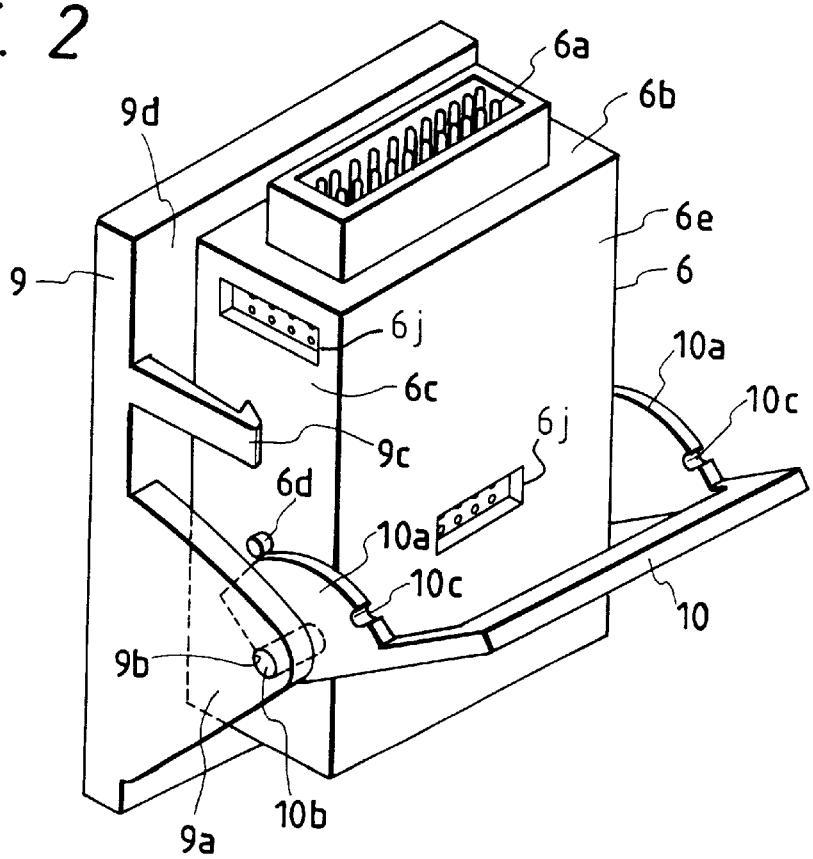
FIG. 2 is a perspective view showing an electric connection box and a frame in a first embodiment of the invention.

As shown in FIG. 2, the connector portion 6*a* for fitting connection to the connector 5 on the instrument panel 3 is formed on the upper surface 6*b* of the electric connection box 6.

Although not specifically shown, connector portions for fitting connection respectively to connectors of other wire harnesses are formed respectively on opposite side surfaces 6*c* and a rear surface 6*e* of the electric connection box 6. Examples of these other connector portions are shown as 6*j* in FIGS. 2 and 8A.

A frame 9 of a synthetic resin is fixedly secured to the cowl panel 2, and has a pair of bracket portions 9*a* and 9*a* integrally formed respectively at opposite side portions of a lower end portion thereof, the bracket portions 9*a* and 9*a* projecting toward the rear of a vehicle body. An operating lever 10 has a pair of fan-shaped cam portions 10*a* and 10*a* formed respectively at opposite side portions thereof, and rotation pins 10*b* and 10*b*, formed respectively on the cam portions 10*a* and 10*a*, are fitted respectively in pin holes 9*b* formed respectively through the bracket portions 9*a* and 9*a*. Thus, the operating lever 10 is supported on the frame 9 for being turned (pivotally moved) forwardly and rearwardly relative to the frame 9.

The electric connection box 6 is fitted in a space between the frame 9 and the operating lever 10 in such a manner that cam pins 6*d* and 6*d*, formed respectively on the opposite side surfaces 6*c* and 6*c* of the electric connection box 6, rest respectively on upper edges (upper surfaces) of the fan-shaped cam portions 10*a* and 10*a*, thus supporting the electric connection box 6 by the operating lever 10.

Figure 7A:
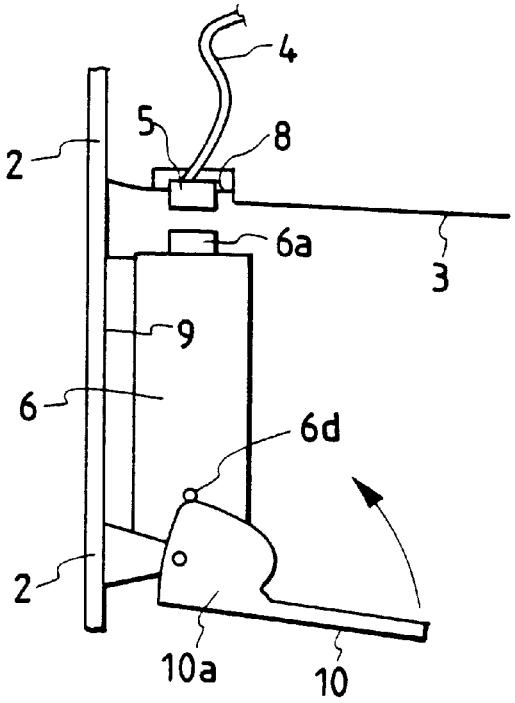
FIGS. 7(A) to 7(D) are views explanatory of a process of connecting the electric connection box.
Figure 7B:
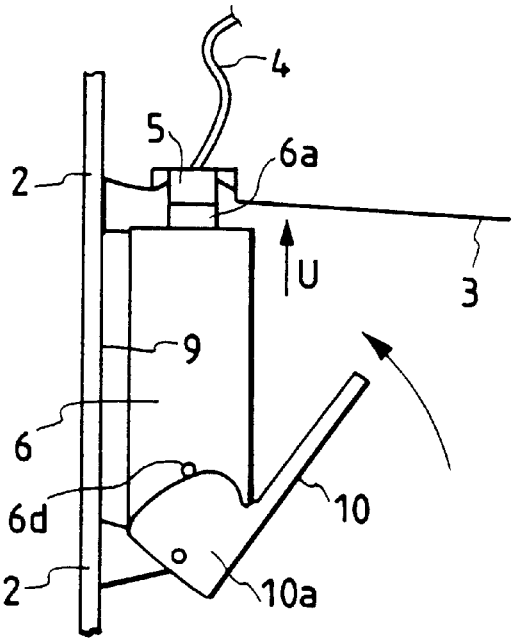
Figure 7C:
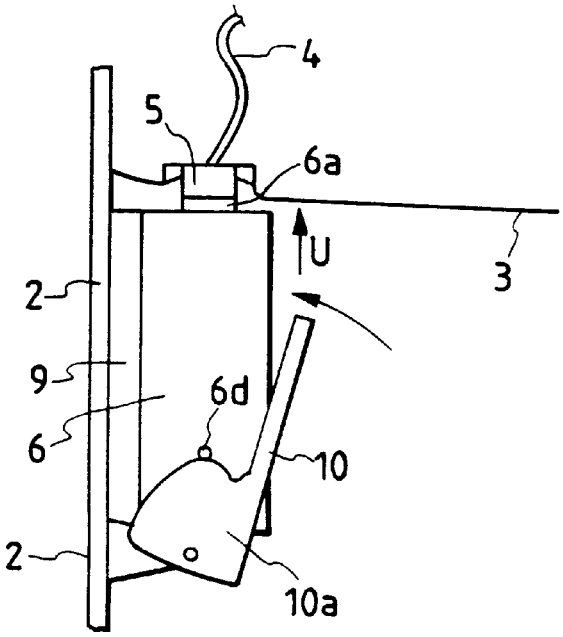
Figure 7D:
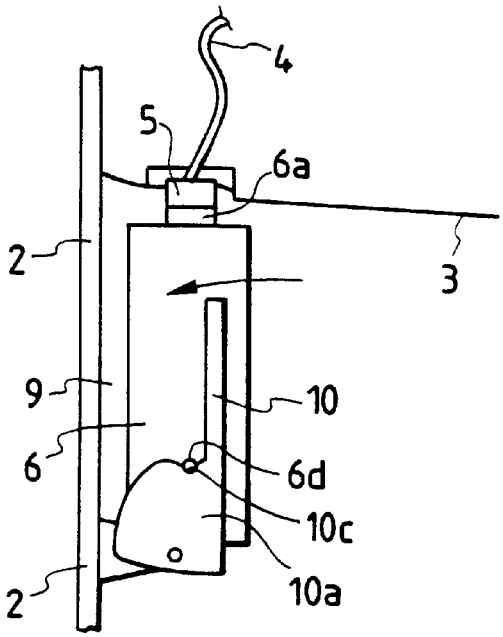

The operating lever 10, when in its rearwardly-turned position, supports the electric connection box 6 in a lowered position thereof, as shown in FIG. 7(A). When the operating lever 10 is turned forwardly, the fan-shaped cam portions 10*a* of the operating lever 10 move the electric connection box 6 upward (in the direction of arrow U) through the cam pins 6*d*, as shown in FIG. 7(B). Immediately before the operating lever 10 reaches its forwardly-turned position, the connector portion 6*a* of the upwardly-moving electric connection box 6 begins to fit in the connector 5 on the instrument panel 3, as shown in FIG. 7(C), and then in the forwardly-turned position of the operating lever 10, the connector portion 6*a* of the electric connection box 6 completely fits in the connector 5, as shown in FIG. 7(D).

A recess 10*c* is formed in the upper end of each fan-shaped cam portion 10*a*, and when the operating lever 10 reaches its forwardly-turned position, each cam pin 6*d* on the electric connection box 6 slightly moves downward to be received in the associated recess 10*c*, so that the electric connection box 6 moves downward slightly apart from the instrument panel 3. With this arrangement, vibrations of the instrument panel 3 will not be transmitted to the electric connection box 6.

A pair of lock pawls 9*c* and 9*c* are integrally formed respectively at the opposite side portions of the frame 9, and these lock pawls 9*c* and 9*c* engage the operating lever 10 to retain the same in its upwardly-turned position.

Figure 5A:
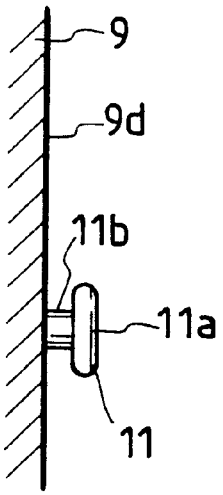
FIG. 5(A) is a side-elevational view of a pin of a first example of a slide construction for the electric connection box.
Figure 5B:
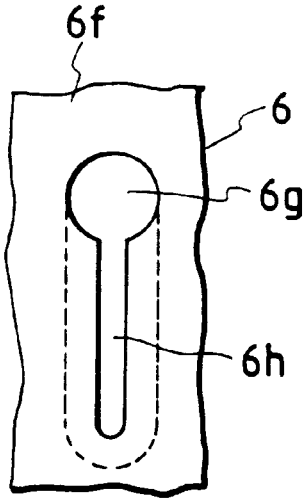
FIG. 5(B) is a front-elevational view showing a slot of this slide construction.

In order to accurately move the electric connection box 6 upward and downward along the frame 9, a guide pin 11 is formed on a rear surface 9*d* of the frame 9, and a round hole 6*g*, as well as a slot 6*h* of a stepped construction extending downwardly from the round hole 6*g*, is formed in a front surface 6*f* of the electric connection box 6, as shown in FIG. 5. A head 11*a* of the guide pin 11 is fitted in the round hole 6*g*, and the head 11*a* and a shank 11*b* of the guide pin 11 are guided by the slot 6*h*.

Figure 6:
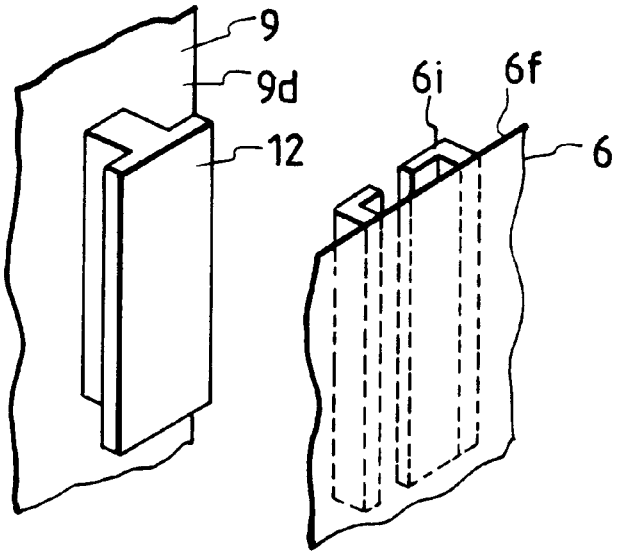
FIG. 6 is a perspective view showing a second example of a slide construction for the electric connection box.

Alternatively, as shown in FIG. 6, a rail 12 of a T-shaped cross-section is formed on the rear surface 9*d* of the frame 9, and extends in the upward-downward direction, and a rail groove 6*i* for receiving the rail 12 is formed in the front surface 6*f* of the electric connection box 6.

Figure 4A:
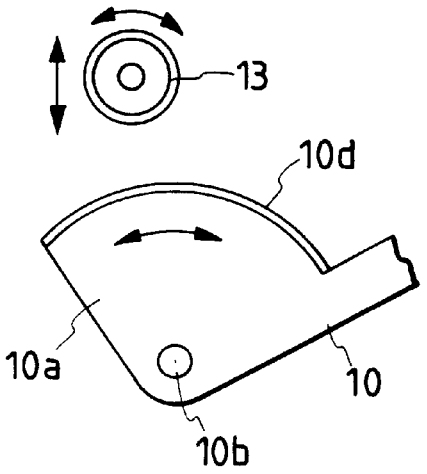
FIGS. 4(A) and 4(B) are side-elevational views showing modified operating levers, respectively.

As shown in FIG. 4(A), there may be used an arrangement in which instead of the cam pins 6*d*, a pair of pinions 13 are rotatably mounted respectively on the opposite side surfaces 6*c* of the electric connection box 6, and instead of the cam surfaces formed respectively on the upper edges of the fan-shaped cam portions 10*a* of the operating lever 10, arcuate gear portions 10*d* for respectively meshing the pinions 13 are formed. In this case, the operating lever 10 is pivotally moved to rotate the pinions 13 through the arcuate gear portions 10*d*, thereby moving the electric connection box 6 upward.

Figure 4B:
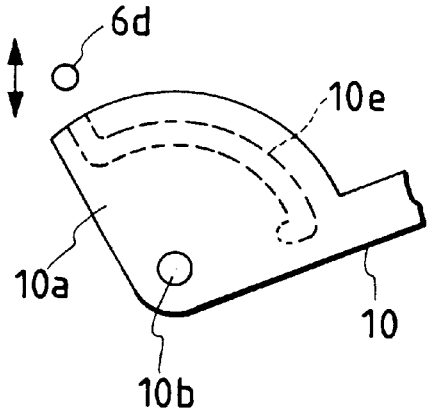

As shown in FIG. 4(B), there may be used another arrangement in which instead of the cam surfaces formed respectively on the upper edges of the fan-shaped cam portions 10*a* of the operating lever 10, cam grooves 10*e* for respectively receiving the cam pins 6*d* on the electric connection box 6 are formed respectively in the inner surfaces of the fan-shaped cam portions 10*a*. In this case, the operating lever 10 is pivotally moved forwardly to move the electric connection box 6 upward through the cam grooves 10*e* formed respectively in the fan-shaped cam portions 10*a*.

In the construction of the first embodiment, the electric connection box 6 is fitted in the space between the frame 9 and the operating lever 10 held in its rearwardly-turned position (FIG. 7(A)), and when the operating lever 10 is pivotally moved forwardly (FIG. 7(B)), the fan-shaped cam portions 10*a* of the operating lever 10 move the electric connection box 6 upward through the cam pins 6*d*, so that the connector portion 6*a* on the upper surface 6*b* of the electric connection box 6 is fitted in the connector 5 on the instrument panel 3, and in the forwardly-turned position of the operating lever 10 (FIG. 7(D)), the connector portion 6*a* of the electric connection box 6 completely fits in the connector 5.

Thus, by pivotally moving the operating lever 10, the connector portion 6*a* of the electric connection box 6 can be fitted in the connector 5 on the instrument panel 3, and therefore the connector portion 6*a* can be formed on the upper surface 6*b* of the electric connection box 6, and the connector portion 6*a* (which has been formed on a surface other than the upper surface of the electric connection box in the conventional construction) for connection to the connector 5 of the instrument panel harness 4 can be formed on the upper surface 6*b*, and therefore the electric connection box 6 can be formed into a smaller size.

Even if a gap T between the lower surface 3*a* of the instrument panel 3 and the upper surface 6*b* of the electric connection box 6 is small, the connector portion 6*a* of the electric connection box 6 can be fitted into the connector 5 on the instrument panel 3 merely by pivotally moving the operating lever 10, and therefore the efficiency of fitting the connector 5 is enhanced.

FIGS. 8(A)–(C) and 9(A)–(C) show the second embodiment in which the connector 5 on the instrument panel 3 is moved downward for fitting connection.

Figure 8A:
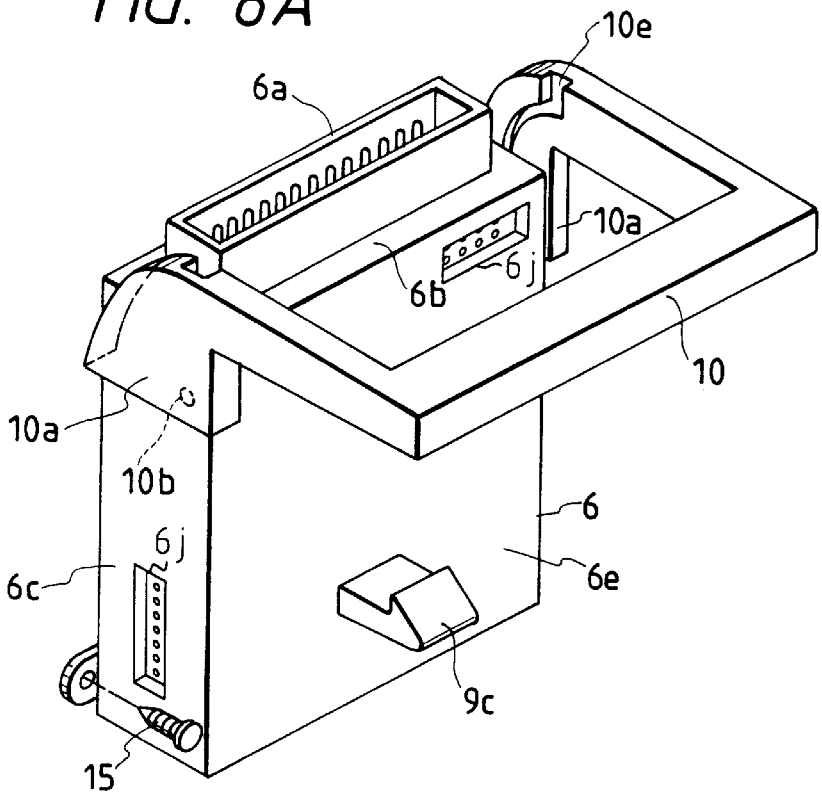
FIG. 8(A) is a perspective view of an electric connection box in a second embodiment of a connection construction of the invention.
Figure 8B:
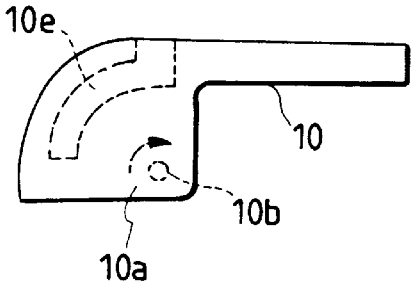
FIG. 8(B) is a side-elevational view of an operating lever in the second embodiment.
Figure 8C:
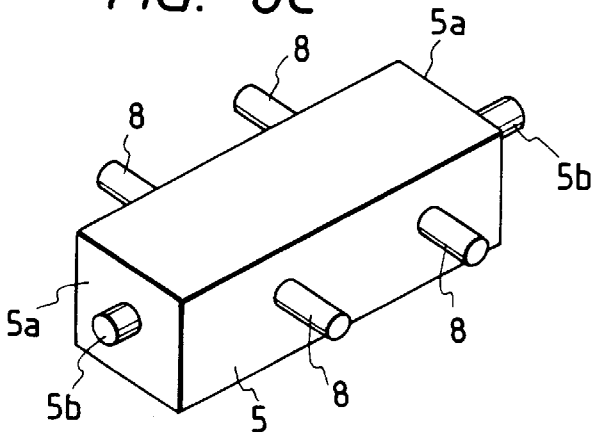
FIG. 8(C) is a perspective view of a connector in the second embodiment.

As shown in FIG. 8(A), the electric connection box 6 is fixedly secured directly to the cowl panel 2 by screws 15.

Pins 10*b* and 10*b*, formed respectively on inner surfaces of fan-shaped cam portions 10*a* formed respectively at opposite side portions of an operating lever 10, are fitted respectively in pin holes (not shown) formed respectively in opposite side surfaces 6*c* of the electric connection box 6, and therefore the operating lever 10 is supported on the electric connection box 6 for being turned (pivotally moved) upward and downward relative to the electric connection box 6.

A pair of cam pins 5*b* and 5*b* are formed respectively on opposite (right and left) side surfaces 5*a* and 5*a* of the connector 5 on the instrument panel 3, and cam grooves 10*e* for respectively receiving the cam pins 5*b* and 5*b* are formed respectively in the inner surfaces of the fan-shaped cam portions 10*a* of the operating lever 10. The operating lever 10 is pivotally moved downward to move the connector 5 downward through the cam pins 5*b* and the cam grooves 10*e* in the fan-shaped cam portions 10*a*.

A lock pawl 9*c* is formed integrally on a rear surface 6*e* of the electric connection box 6, and this lock pawl 9*c* retains or locks the operating lever 10 when this lever 10 is in its downwardly-turned position.

Figure 9A:
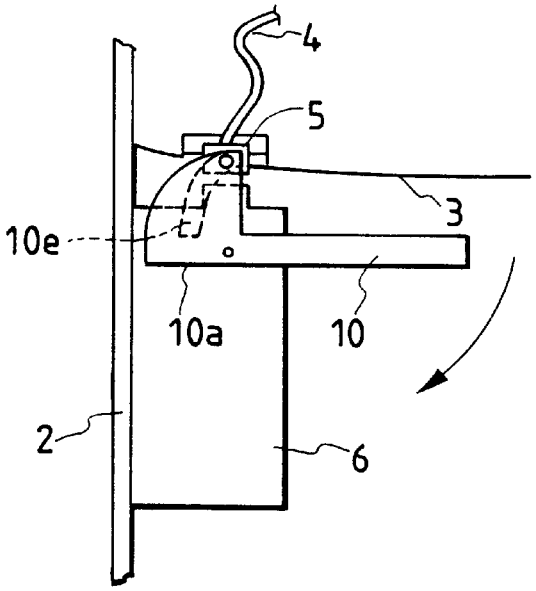
FIGS. 9(A) to 9(C) are views explanatory of a process of connecting the electric connection box.

In the construction of the second embodiment, the electric connection box 6 is beforehand fixed to the cowl panel 2, and the cam pins 5*b* of the connector 5 on the instrument panel 3 are fitted respectively in inlet portions of the cam grooves 10*e* formed respectively in the fan-shaped cam portions 10*a* of the operating lever 10, as shown in FIG. 9(A).

Figure 9B:
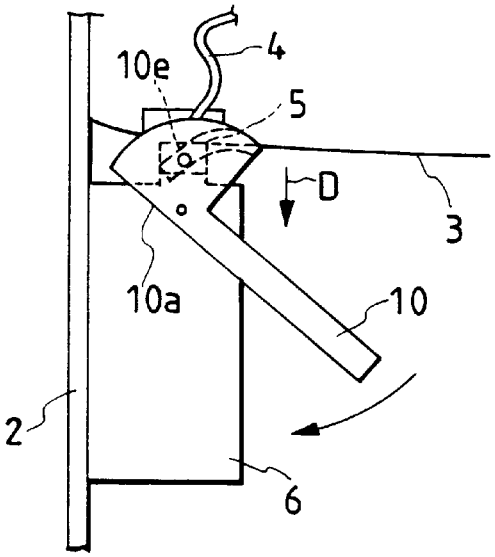
Figure 9C:
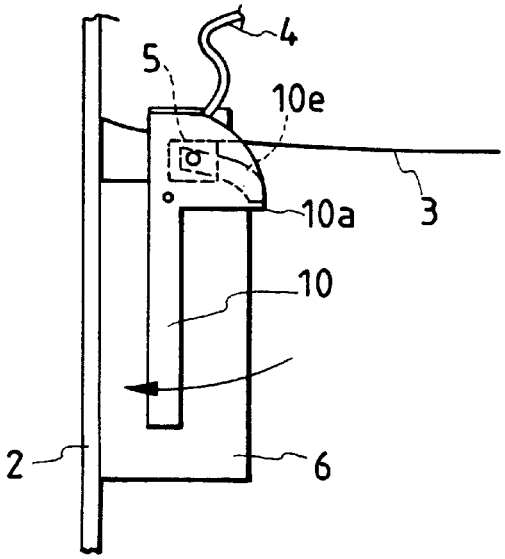
Figure 10A:
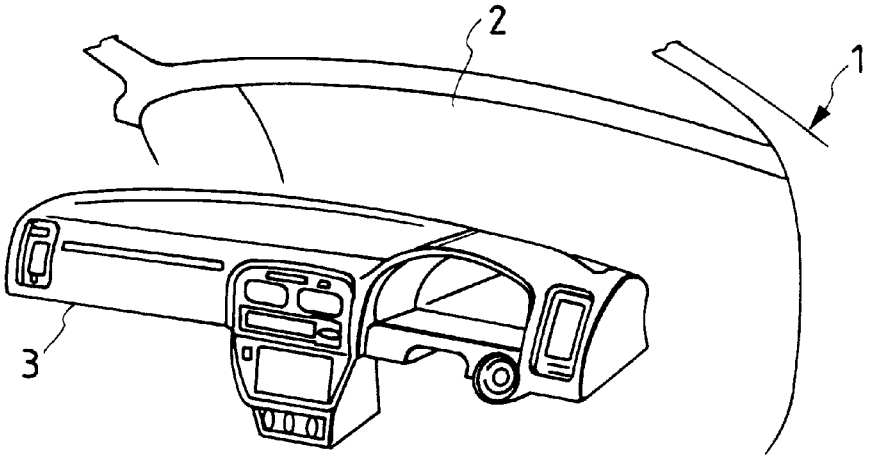
FIG. 10A PRIOR ART
FIG. 10(A) is a perspective view showing an instrument panel of an automobile.
Figure 10B:
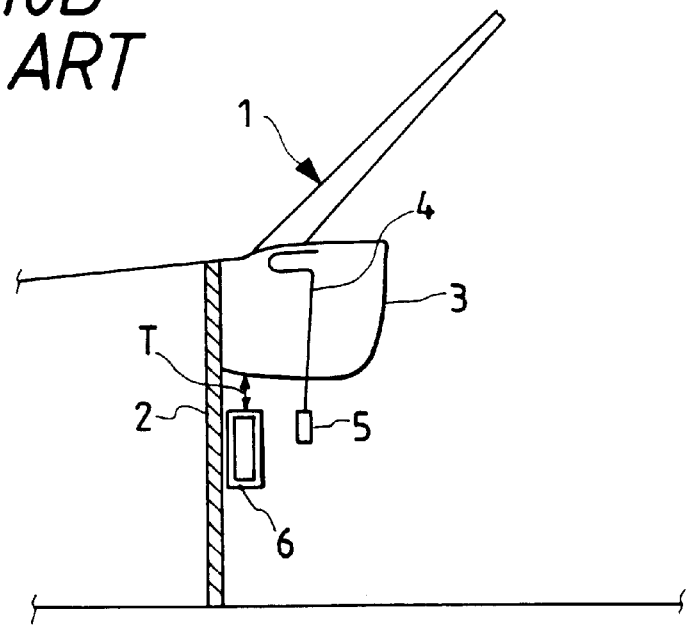
FIG. 10B PRIOR ART
FIG. 10(B) is a side-elevational view showing a conventional connection construction.

Then, when the operating lever 10 is pivotally moved downward as shown in FIG. 9(B), the connector 5 is moved downward through the cam pins 5 and the cam grooves 10*e* (formed respectively in the fan-shaped cam portions 10*a* of the operating lever 10) against a resilient force of resilient support members 8 (which resiliently support the connector 5), and the connector 5 on the instrument panel 3 is fitted on the connector portion 6*a* formed on the upper surface 6*b* of the electric connection box 6, and in the downwardly-turned position of the operating lever 10, the connector 5 completely fits on the connector portion 6*a* of the electric connection box 6, as shown in FIG. 9(C).

Thus, by pivotally moving the operating lever 10, the connector 5 on the instrument panel 3 can be fitted on the connector portion 6*a* of the electric connection box 6, thereby achieving similar effects as attained in the first embodiment.

What is claimed is:

1. A connector system for connecting an electric connection box for an instrument panel harness mounted on an instrument panel of a vehicle body, the electric connection box being attached to a fixed cowl panel of the vehicle body, the connector system comprising:

a side surface of said electric connection box, the side surface having a slide mount slidably attaching said electric connection box to the fixed cowl panel;

a connector portion formed on an upper surface of said electric connection box and facing toward the instrument panel;

a connector connected to the instrument panel harness and fittingly connected to said connector portion;

an operating lever pivotably attached to said fixed cowl panel and moving said electric connection box along said slide mount relative to the connector to cause the electric connection box and the connector to be electrically interconnected; and other connector portions formed on surfaces of said electric connection box other than said upper surface thereof, said other connector portions being connectable to connectors of wire harnesses other than the instrument panel harness.

2. The connector system for connecting an electric connection box for an instrument panel harness according to claim 1, wherein said electric connection box is located vertically below the instrument panel.

3. A construction for connecting an electric connection box for an instrument panel harness according to claim 1, wherein said connector of said instrument panel harness is mounted on said instrument panel through resilient support members.

4. A construction for connecting an electric connection box for an instrument panel harness according to claim 1, wherein said electric connection box is mounted on said cowl panel so as to reciprocate relative to said instrument panel.

5. The connector system for connecting an electric connection box for an instrument panel harness according to claim 4, wherein said electric connection box is slidably supported on upper surfaces of cam portions formed on said operating lever, such that pivoting movement of said operating lever moves said electric connection box toward the instrument panel.

6. A construction for connecting an electric connection box for an instrument panel harness according to claim 3, wherein said electric connection box is mounted on said cowl panel so as to reciprocate relative to said instrument panel.

7. The connector system for connecting an electric connection box for an instrument panel harness according to claim 6, wherein said electric connection box is slidably supported on upper surfaces of cam portions formed on said operating lever, such that pivoting movement of said operating lever moves said electric connection box toward the instrument panel.

8. A method for connecting an electric connection box attached to a fixed cowl panel of a vehicle body to an instrument panel harness, the method comprising the steps of:

forming a connector portion on an upper surface of the electric connection box, the upper surface facing vertically upward and the connector portion and the upper surface of the electric connection box facing toward an instrument panel;

pivoting an operating lever pivotably connected to the fixed cowl panel;

connecting the connector portion on the upper surface of the electric connection box to a connector on the instrument panel harness by sliding the electric connection box along the fixed cowl panel by the pivoting motion of the operating lever; and forming other connector portions on surfaces of the electric connection box other than the upper surface thereof, said other connector portions being connectable to connectors of wire harnesses other than the instrument panel harness.

9. A method for connecting an electric connection box to an instrument panel harness according to claim 8, wherein said electric connection box is located vertically below the instrument panel.

10. A method for connecting an electric connection box to an instrument panel harness, comprising the steps of:

forming a connector portion on an upper surface of the electric connection box, the connector portion and the upper surface of the electric connection box facing toward an instrument panel;

attaching a connector on the instrument panel harness to the instrument panel;

movably attaching the electric connection box to a fixed cowl panel for reciprocal movement relative to the instrument panel;

pivoting an operating lever pivotably connected to the fixed cowl panel in a mating direction;

connecting the connector portion on the upper surface of the electric connection box to the connector on the instrument panel harness by moving one of the connector and the electric connection box in the mating direction toward an other one of the connector and the electric connection box by the pivoting motion of the operating lever pushing the one of the connector and the electric connection box; and forming other connector portions on surfaces of the electric connection box other than the upper surface thereof, said other connector portions being connectable to connectors of wire harnesses other than the instrument panel harness.

11. A method for connecting an electric connection box to an instrument panel harness according to claim 10, wherein said electric connection box is located vertically below the instrument panel.

12. The method of claim 10, wherein the connector moves with respect to the fixed cowl panel.

13. The method of claim 10, wherein the electric connection box moves with respect to the fixed cowl panel.

* * * * *